United States Patent [19]

Pellegri

[11] 4,118,294

[45] Oct. 3, 1978

[54] NOVEL CATHODE AND BIPOLAR ELECTRODE INCORPORATING THE SAME

[75] Inventor: Alberto Pellegri, Luino (Va), Italy

[73] Assignee: Diamond Shamrock Technologies S. A., Geneva, Switzerland

[21] Appl. No.: 834,418

[22] Filed: Sep. 19, 1977

[51] Int. Cl.[2] ..... C25B 1/02; C25B 11/04; C25B 11/08

[52] U.S. Cl. ..... 204/129; 204/270; 204/278; 204/290 F; 204/290 R; 204/291; 204/294

[58] Field of Search ..... 204/290 R, 291, 294, 204/278, 129, 270, 290 F

[56] References Cited

U.S. PATENT DOCUMENTS

| | | | |
|---|---|---|---|
| 3,444,004 | 5/1969 | Smith | 429/42 |
| 3,856,574 | 12/1974 | Amagi et al. | 204/294 |
| 3,884,792 | 5/1975 | McGilvery | 204/290 F |
| 3,920,535 | 11/1975 | Schultz et al. | 204/290 F |
| 4,000,048 | 12/1976 | Bianchi et al. | 204/290 F |

*Primary Examiner*—R. L. Andrews
*Attorney, Agent, or Firm*—Bruce M. Winchell

[57] ABSTRACT

A hydrogen evolution cathode for electrochemical reactions consists of a body formed of a powdered electrically conductive material embedded in a cured thermosetting resin and having a cathodically operative surface enriched with powder of a hydrogen evolution catalyst, the powdered conductive material preventing the diffusion of atomic hydrogen through the cathode body. The cathode may be incorporated in a bipolar electrode by bonding it to a thin sheet of valve metal coated with an anodic electrocatalytic material, the body being advantageously extended by projecting parts of electrically insulating cured resin.

20 Claims, 2 Drawing Figures

NOVEL CATHODE AND BIPOLAR ELECTRODE INCORPORATING THE SAME

FIELD OF THE INVENTION

Figure 1:
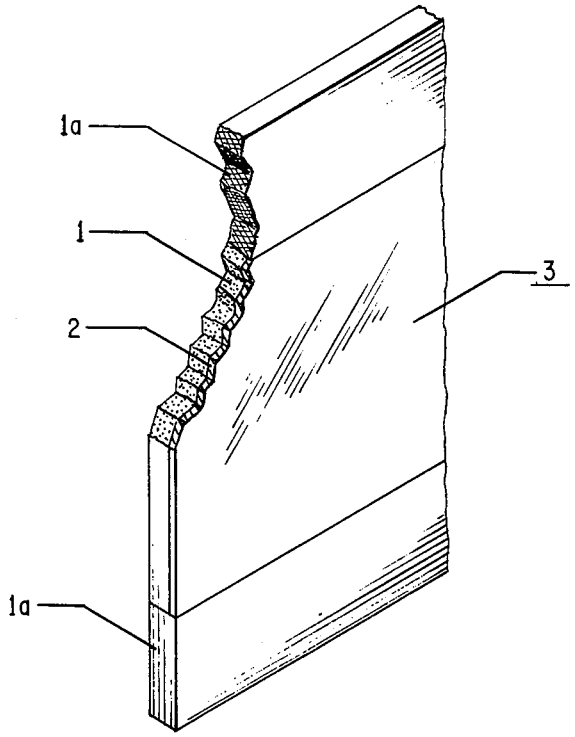

The invention pertains to electrochemical devices and processes wherein electrochemical oxidation and reduction reactions in aqueous media are conducted on the surfaces of cooperating anodes and cathodes for the purpose of decomposing the electrolyte and recovering the products of the reaction with the expenditure of electrical energy, as in electrolytic cells.

In particular, the invention concerns hydrogen evolution cathodes notably as part of bipolar electrodes for electrochemical cells with or without a diaphragm, used for the electrolysis of brines, acid solutions and alkaline solutions, and for the production of hydrogen and oxygen by the electrolysis of water in acid or alkaline electrolytes.

STATE OF THE ART

Various cathodes have been studied for use in electrochemical reactions involving hydrogen evolution. Since the technical breakthrough of corrosion-resistant valve metal electrodes, especially dimensionally stable anodes, many efforts have been made to obtain a valve metal supported bipolar electrode which could be activated over one surface with an anodically resistant and electrocatalytic coating, typically comprising a platinum group metal or platinum group metal oxide, and which could perform satisfactorily as a hydrogen evolution cathode over its other surface.

When hydrogen ions are cathodically discharged they plate onto the cathode surface and immediately tend to form molecular hydrogen which is evolved as minute gas bubbles. Part of the hydrogen atoms are adsorbed on the surface and diffuse into the crystal lattice of the metal cathode giving rise to the formation of hydrides which may precipitate at the grain boundaries within the metal structure.

Valve metal electrodes can evolve hydrogen at reasonably low overpotentials but are badly effected by adsorbed hydrogen atoms which migrate into the valve metal and form hydrides, causing expansion of the valve metal lattice, weakening of its structure and falling or peeling off of the electrocatalytic coating.

Proposals to solve this problem are described in U.S. Pat. No. 4,000,048, whereby the valve metal is coated with a layer of palladium-silver or palladium lead alloy having a hydrogen desorption/adsorption ratio lower than unity. However, this involves the use of expensive noble metal cathodic coatings.

In many industrial applications such as the electrolysis of alkali metal halides, iron cathodes are widely used because of their low cost and it is customary to avoid the problems which would arise by the diffusion of atomic hydrogen through the iron cathode into the valve metal anode bases by the interposition of a sheet of a third metal, such as copper or silver, which is sufficiently thick to stop the diffusion of hydrogen. However these three-metal sandwich assemblies are relatively expensive, and moreover the intermediate metal must be protected to avoid corrosion by contact with the electrolyte.

Recently, other bipolar electrode assemblies with reportedly low hydrogen permeability rates have been proposed. U.S. Pat. No. 3,920,535 describes a multilayer composite comprising a valve metal plate coated with a suitable anodic material over one surface and with a silicon layer over the opposite surface, the silicon being protected by a metal coating suitable to the cathodic conditions. This silicon layer is intended to reduce hydrogen diffusion through the composite assembly but, due to the low electrical conductivity of silicon, must be relatively thin. Therefore, a compromise is necessary between electrical conductivity and low atomic hydrogen diffusion rates.

Another publication of interest is U.S. Pat. No. 3,884,792 relating also to multilayered metal electrodes having an intermediate layer of a metal substantially resistant to hydrogen diffusion. Generally speaking, the fabrication of known composite bipolar electrodes is complex and needs accurate control of the various coating processes to avoid damaging the adherence of previously applied layers.

OBJECTS OF THE INVENTION

One object of the invention is to provide a novel cathode suitable for hydrogen evolution, resistant to atomic hydrogen diffusion and having a low hydrogen overpotential. A further object is to provide such a cathode which is rigid and self-sustaining and can be easily moulded and/or bonded to any electrically conductive substrate that must be protected from hydrogen embrittlement.

Additionally, it is intended to provide a novel bipolar electrode comprising a thin valve metal anode substrate bonded to a rigid and self-sustaining cathode which is substantially impervious to atomic hydrogen diffusion.

The invention also aims to provide a novel method of producing such cathodes and bipolar electrodes incorporating the same.

Yet another object of the invention is to provide an improved bipolar cell design incorporating such bipolar electrodes.

SUMMARY OF THE INVENTION

According to the invention, a hydrogen-evolution cathode for electrochemical reactions comprises a body which is substantially impervious to the diffusion therethrough of atomic hydrogen, said body being formed of an aggregate of powdered electrically conductive material embedded in electrically conducting relationship in a cured thermosetting resin and having a cathodically active surface enriched with a powder of a hydrogen evolution catalyst.

This cathode has a low hydrogen overpotential and effectively resists the migration of atomic hydrogen through its bulk.

The thermosetting resin may be a furane, phenolic or epoxy resin, or plastic alloys thereof including various proprietary brands of said resins. The powdered electrically conductive material may be carbon, graphite, chromium, tungsten, iron, nickel, cobalt, cadmium, copper, zinc, molydenum, silver or metal carbides, nitrides, hydrides, borides and silicides, or mixtures thereof.

It has been found that such powders formed as a cured aggregate with the thermosetting resin become exceptionally resistant to atomic hydrogen migration, even though the materials in solid form would readily allow the diffusion of atomic hydrogen through their bulk if utilized as a hydrogen discharging cathode. A thickness of as little as 1mm of such cured aggregate is practically impervious to the diffusion of hydrogen atoms, although a 1.5mm or thicker layer may be preferred. The imperviousness to hydrogen diffusion may be explained by the high number of interfaces between contacting particles across the thickness of the aggregate body. These interfaces form potential barriers to the diffusing hydrogen atoms and bring diffusion effectively to a stop within a short distance from the cathode surface at which hydrogen ions are discharged and adsorbed.

The cathodic discharge of hydrogen is a surface phenomena and the operative surface of the cathode is enriched with powder of a cathodically active hydrogen evolution catalyst, in order to avoid uneconomically high overvoltages at the high current densities which are customary in commercial electrolysis cells.

Enrichment of the operative top layers of the aggregate cathode can be effected during the forming process before curing by spreading excess powder of the catalytically active material on the surface of the formed cathode and pressing the powder to embed it in the superficial layers of the aggregate. Alternatively, the powder of the catalytically active material can be mixed with the resin in the highest weight ratio allowed by the resin, which, for iron and nickel powder having a mesh number of between 100 and 250, can be as high as 90 to 97%, and the plastic mixture can be spread over the surface of the formed cathode before final pressing and cure.

Suitable catalysts are materials having low hydrogen overpotentials such as iron and nickel preferably in their most active forms such as Raney nickel and similar high "real surface" forms of the metals. Other powdered materials exceptionally catalytic with respect to hydrogen evolution, e.g. activated noble metals such as platinum and palladium black, can also be incorporated in the superficial layers of the aggregate cathode; while such catalysts will further reduce overvoltages, especially at high current densities, they would add considerably to the cost of the otherwise inexpensive cathode and would only be used when special conditions are encountered.

According to a preferred embodiment of the invention, particularly suited for the electrolysis of brines and alcaline water solutions, the cathode is formed of a substrate layer having a thickness of 1 to 3 mm consisting of an aggregate of resin and powdered copper, graphite, molybdenum, chromium or TiC, or mixtures of the same, and a cathodically operative top layer consisting of an aggregate of resin and finely divided iron or nickel, advantageously Raney nickel, or mixtures of the same. The cathodically operative top layer preferably has thickness of at least 0.5 m/m, and possibly as great as 2mm or more.

This cathode can be prepared by firstly moulding the substrate layer from a plastic mixture of resin and its powder, preferably in a weight ratio between 30:70 and 20:80, and then moulding on top of the substrate a further layer of a plastic mixture of resin and powder of the catalytic active material, preferably in a weight ratio between 10:90 and 3:97. After cure, the aggregate becomes a monolithic article combining the properties of high catalytic activity for a low overvoltage at high current density, and substantial imperviousness to atomic hydrogen diffusion through its cross-section.

Cathodes of the invention can be easily moulded or laminated in various simple and complicated shapes to suit the design of the electrochemical reactor in which they are to be incorporated, according to known methods used in the plastic industry requiring a minimum of manufacturing steps and resulting in an economical process of manufacture.

Moreover, the cathodes can be moulded or laminated directly over any suitable electrically conductive substrate to which the cured cathode adheres permanently and effectively protects the metal substate from hydrogen embrittlement.

A bipolar electrode of the invention comprises a valve metal anode coated over an anodically active surface with a layer of an electrocatalytic anodically resistant material and a cathode bonded to the anode in electrically conducting relationship, the cathode comprising a body which is substantially impervious to the diffusion therethrough of atomic hydrogen, said body being formed of powdered electrically conductive material embedded in electrically conductive relationship in a cured thermosetting resin and having a cathodically active surface enriched with a powder of a hydrogen evolution catalyst.

The valve metal sheet preferably has an anodically resistant and electrocatalytic coating layer consisting of platinum group metal and valve metal oxides as described in British Patent Specifications Nos. 1,147,442 and 1,195,871.

The cathodes and the bipolar electrodes of the invention are valuable in electrolytic reactions in acqueous media. They are particularly useful for hydrogen evolution in the electrolysis of sea water or dilute brines for the production of hypohalites; brines for the production of halates or for the production of halogen and caustic; and water in both acid and alkaline media for the production of hydrogen and oxygen.

The cathodes and bipolar electrodes of the invention may also be used in fuel cells and other electrochemical devices wherein the electrodes must have a low hydrogen discharge overpotential and effectively resist the migration of atomic hydrogen.

An advantage of the bipolar electrodes of the invention is that the body of the cured aggregate is structurally self-substaining and mechanically rigid, and therefore the valve metal anodic structure can be made of a very thin sheet having a thickness as low as 0.1 m/m which per se would not be sufficiently rigid; comsequently, a large saving of expensive metal is achieved.

According to a preferred method of preparing the cathodes, the thermosetting resin, which may consist of one-component or be a two-component compound which is mixed just before utilization, is thoroughly mixed in liquid form with the finely divided electrically conductive material, having a granulometry preferably of between 80 and 350 mesh, in order to obtain a homogenous mixture.

The weight ratio between the thermosetting resin and the electrically conductive material is preferably between 30:70 and 20:80 since within this range, and with most of the materials used, an optimum compromise is achieved between electrical conductivity and mechanical toughness of the cured aggregate.

The mixture is transferred into a mould and sufficiently pressed to shape the cathode. The mould is opened again and powder of catalytic material is sparged over the surface of the article by any convenient means; alternatively, a premixed plastic mixture of resin and powdered catalytic material in a weight ratio from 3:97 to 10:90 may be spread on the surface. Then the article is further pressed into its final shape.

It has been found highly desirable to allow or induce a plastic flow during the final moulding in order to achieve a maximum electrical conductivity by the establishment of good contacts between the electrically conductive particles.

The moulded article is then cured at room conditions, or preferably at a temperature from 30° to 120° C. until complete hardening of the resin.

It is preferable to maintain the moulding pressure on the article for at least a first period of the cure until a substantial hardening of the resin has taken place, since this has been found to improve the electrical conductivity of the cured aggregate, and also checks minor shrinkages of the moulded article during cure.

The choice of the thermosetting resin depends on the particular use of the cathode or bipolar electrode.

Phenolic, furane, epoxy resins and plastic alloys thereof are all well suited for alcaline environments and therefore can be used as cathode components in particular applications such as in membrane cells for brine or HCI electrolysis or in alkaline electrolyte where they are not subjected to an acid environment even during shut-down.

It has been ascertained that several commercially available resin compositions are also substantially resistant to strong acids such as HCI, $H_2SO_4$, and $HNO_3$ up to 30 to 40% concentration, as well as to wet chlorine. These resins are thus exceptionally resistant to both alkaline and acid environments including wet chlorine up to the concentrations which are found in commercial electrolysis processes such as the electrolysis of brines in diaphragm-less cells for the production of hypochlorites and chlorate.

Examples are the two component epoxy based compound XG-7/XG-8 produced by Ciba-Geigy and the series of "Asplit" (Trademark) mastics and acid proof cements HD, HFR and SWK produced by Farbwerke Höchst A.G.

In general, epoxy-based resins are to be preferred to other types of thermosetting resins because they generally allow a higher loading of conductive material and give aggregates having a higher mechanical strength and toughness; furthermore they confer a greater bonding strength to the cured aggregate when the aggregate cathode is laminated or moulded directly over an electrically conductive substrate as in bipolar electrode assemblies.

A particularly useful electrode, which is specially suitable for bipolar diaphragm-less electrolyzers used for the production of hypohalites or halates by electrolysis of brines, comprises a substantially planar valve metal anode coated over an anodically active surface with a layer of an electrocatalytic anodically resistant material and a cathode bonded to the anode in electrically conducting relationship, the cathode comprising a body which is substantially impervious to the diffusion therethrough of atomic hydrogen, said body being formed of an aggregate of powdered electrically conductive material embedded in electrically conductive relationship in a cured thermosetting resin and having a cathodically active surface enriched with a powder of a hydrogen evolution catalyst, said body being extended beyond at least one side of the cathode and the active surface of the anode by at least one part of cured electrically insulating resin. Preferably, said body and said active surface of the anode are rectangular and are disposed in substantially coincident juxtaposition with two electrically insulating parts of cured resin extending from opposite edges thereof. Such extensions preferably have the same thickness as the composite electrode and extend along a length of at least 10 and preferably more than 20 times their thickness.

When a series of these bipolar electrodes are operatively disposed in a parallel relationship and spaced from one another by an interelectrodic gap which is usually between 1.5 and 4 mm, the extensions of electrically insulating resin act as screening baffles to prevent electrical current pass-by and through the electrolyte contained in the electrolyzer from the edges of high potential electrodes to the edges of low potential electrodes in the bipolar series.

The dramatic corrosive effects of current by-passing in bipolar arrangements of electrodes are well known and we have found that the above-mentioned bipolar electrode construction effectively prevents such phenomena.

Insulating resin extensions may be provided only at free ends of the electrodes which may conveniently be held, along their two other parallel sides, in slots or guides in side walls of an electrolyzer container. However, a single electrically insulating resin extension may be provided around the entire perimeter of the bipolar electrode if desired.

The extension(s) of insulating resin may be applied after the cathode of the bipolar electrode has already been cured, by casting or moulding the thermosetting resin either unloaded or loaded with powders of chemically resistant insulating materials such as silica and other inert metal oxides. Alternatively, the insulating extension(s) may be moulded and cured together with the cathode. In both cases, the insulating extensions form an integral part of the bipolar electrode structures.

Figure 2:
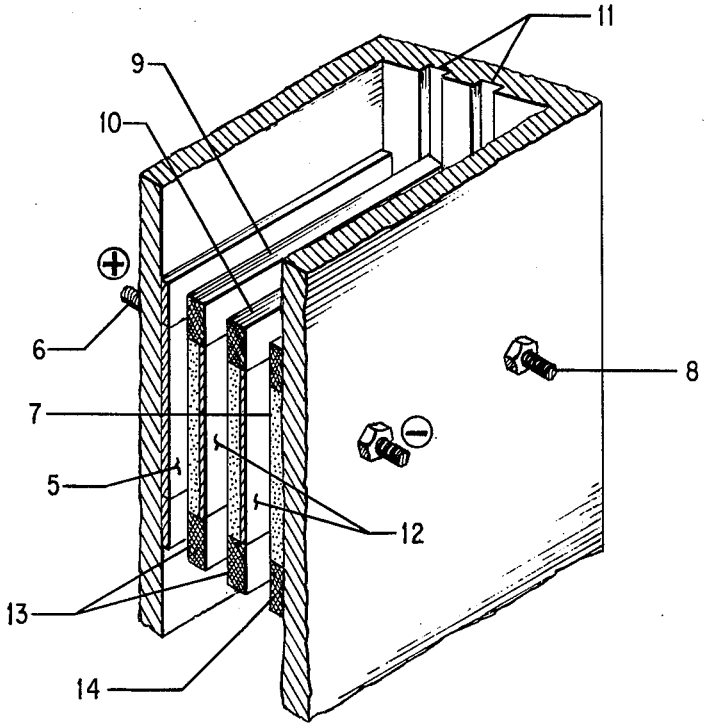

Preferred embodiments of the invention will now be described with reference to the accompanying schematic drawings, in which:

FIG. 1 is a partly cut-away perspective view of a rectangular bipolar electrode of the invention; and FIG. 2 is a part sectioned perspective view of a bipolar electrolyzer, incorporating bipolar electrodes of FIG. 1 and a cathode according to the invention.

The bipolar electrode of FIG. 1 comprises a self-substaining rigid cathode 1 consisting of a layer of an aggregate of a thermosetting resin and powered electrically conductive material having a cathodically active outer surface enriched with a powder of a hydrogen evolution catalyst. By its rear face, the cathode is moulded directly and in electrical conductive relationship over a valve metal anode base 2, which is coated over its outer surface 3 with an electrocatalytic anodically resistant material such as a platinum group metal or a platinum group metal oxide.

Two extensions 1*a* of unloaded (electrically insulating) resin extend from two opposite sides of the cathode 1 and anode 2/3, these extensions having the same thickness as the composite electrode.

The cell of FIG. 2 comprises a vertical container 4 of rectangular section, preferably formed of inert plastic material.

A coated valve metal terminal anode 5 is held in position by metal studs 6 passing through the cell container 4, providing a means for electrical connection to the positive pole of the power supply.

A flat terminal cathode 7, formed of a cured aggregate of thermosetting resin and powdered electrically conductive material and having a cathodically active outer surface enriched with a powder of hydrogen evolution catalyst, is similarly fixed to the opposite surface of the cell container 4 by means of metal studs 8 which serve for electrical connection to the negative pole of the power supply. Two bipolar electrodes 9 and 10, of the type shown in FIG. 1, are positioned in spaced parallel relationship between the terminal anode 5 and the terminal cathode 7. They are conveniently held in place by insertion in vertical slots 11 in the walls of the cell container.

Each bipolar electrode 9 and 10 comprises a coated valve metal anode 12 bonded in electrically conductive relationship to the surface of a resin aggregate cathode, and electrically insulating extensions 13 extending below and above the edges of the anode 12. The extensions 13 are made of unloaded resin.

The terminal cathode 7 also has two electrically insulating extensions of unloaded resin 14 and the terminal anode 5 is coated with its anodically resistant and electrocatalytic coating only in the central region of the valve metal sheet, facing the enriched active cathode surface of the bipolar electrode 9.

In this way the bottom and top portions of the electrodes are electrically insulating with respect to the electrolyte and act as inert baffles preventing the bypass of ionic current from higher potential electrodes, such as the terminal anode 5, to lower potential electrodes, such as the terminal cathode 7, which could cause the breakdown of the passive film on the valve metal structures or the discharge of anions on the cured aggregate electrodes.

A discharge of anions on the aggregate electrodes of the invention would cause blistering leading to failure of the thermosetting resin matrix, and should consequently be prevented.

In operation, electrolyte is normally circulated through the described bipolar cell from the bottom towards the top. The electrolyte may be sea water or dilute NaCl and the electrolysis conducted at room temperature to produce an effluent containing sodium hypochlorite in concentrations of 1 to 3 gr/l.

Examples of specific embodiments of the invention will now be described.

EXAMPLE 1

100 Parts by weight of XG-7 resin were mixed with 52 parts of XG-8. This two-component modified epoxy base thermosetting resin is marketed by Ciba-Geigy.

To samples of the resin mixture, while still in its liquid state, were added powdered electrically conductive materials in percentages indicated in Table 1 and the sample mixtures were homogenized in a mixer.

TABLE 1

| Sample No. | Electrically conductive powder | % by weight | Mesh No. of conductive powder | Powdered catalyst | Mesh No. of catalyst powder |
|---|---|---|---|---|---|
| 1 | Graphite | 70 | 150 to 300 | Iron | 100 to 250 |
| 2 | Iron | 80 | 100 to 250 | Iron | 100 to 250 |
| 3 | Nickel | 75 | 80 to 200 | Nickel | 80 to 250 |
| 4 | Copper | 75 | 150 to 300 | Nickel | 80 to 200 |
| 5 | Chromium | 75 | 100 to 300 | Iron | 100 to 250 |
| 6 | 50% Silver 50% Graphite | 65 | 150 to 350 | Nickel | 80 to 200 |
| 7 | $ZrB_2$ | 70 | 80 to 250 | Nickel | 80 to 200 |
| 8 | $TiB_2$ | 70 | 80 to 250 | Nickel | 80 to 200 |
| 9 | 50% TiC 50% Graphite | 65 | 80 to 250 | Nickel | 80 to 200 |
| 10 | Ni Si | 65 | 80 to 250 | Nickel | 80 to 200 |

From the homogenized sample mixtures, disc shaped test coupons having a diameter of 50mm and a thickness of 3mm were pressed in a mould of Teflon (Trademark). This mould was opened and catalyst powders, as indicated in Table 1, sparged over the surface of the respective coupons. Then, the coupons were further pressed in the mould in such a way as to induce, during moulding, a plastic flow of the powdered materials along planes parallel to the major surfaces of the test coupons.

The formed coupons were cured in an oven at 60° C. for 12 hours, maintaining the forming pressure for the first 5 hours of cure.

The cured test coupons were tested as hydrogen-evolution cathodes in a number of different electrolytic media and the results are set forth in Table 2.

TABLE 2

| SAMPLE NO | AQUEOUS ELECTROLYTE COMPOSITION | TEMPERATURE °C | CURRENT DENSITY a/m² | POTENTIAL V (NHE) INITIAL | POTENTIAL V (NHE) AFTER 8 HOURS | CHANGE IN WEIGHT mg/cm² |
|---|---|---|---|---|---|---|
| 1 | NaCl 200 g/l | 75 | 5000 | −1.3 | −1.3 | + 0.1 |
| 1 | HCl 20% | 75 | 5000 | −1.2 | −1.2 | + 0.2 |
| 1 | $H_2SO_4$ 10% | 75 | 5000 | −1.2 | −1.2 | + 0.2 |
| 2 | NaCl 200 g/l | 75 | 5000 | −1.2 | −1.2 | + 0.1 |
| 2 | HCl 20% | 75 | 5000 | −1.0 | −1.1 | + 0.1 |
| 2 | $H_2SO_4$ 10% | 75 | 5000 | −1.1 | −1.1 | + 0.2 |
| 3 | KOH 29% | 70 | 5000 | −1.3 | −1.4 | + 0.3 |
| 4 | KOH 29% | 70 | 5000 | −1.7 | −1.7 | − 0.2 |
| 5 | NaCl 200 g/l | 75 | 5000 | −1.3 | −1.4 | + 0.5 |
| 6 | NaCl 200 g/l | 75 | 5000 | −1.3 | −1.3 | + 0.1 |
| 7 | NaCl 200 g/l | 75 | 5000 | −1.1 | −1.2 | − 0.2 |
| 8 | NaCl 200 g/l | 75 | 5000 | −1.1 | −1.2 | −0.6 |
| 9 | NaCl 200 g/l | 75 | 5000 | −1.1 | −1.3 | + 0.3 |
| 10 | NaCl 200 g/l | 5000 | −1.8 | −1.9 | + 0.4 | |

EXAMPLE 2

Anodes consisting of a flat rectangular sheet of titanium 0.25mm thick, coated over one surface with an anodically resistant electrocatalytic coating, comprising mixed oxides of at least one valve metal and one metal belonging to the platinum group, were treated by sanding the uncoated titanium surface and chemically cleaning it to remove any unwanted oxide layer.

A 3mm thick layer of an aggregate of thermosetting resin and graphite similar to that of Sample No. 1, Table 1, was moulded directly over the uncoated titanium surface of each anode structure and the moulded articles were cured in an oven at 80° C. for 6 hours.

Before curing, the articles were provided with a frame of about 5 cm in width around their perimeter, consisting of uncured unloaded XG-7/XG-8 resin, by casting the resin in an appropriate mould.

Bipolar electrodes produced in this manner and having a structure similar to that illustrated in FIG. 1 — except that the insulating resin extensions extend around the periphery to form a frame — were assembled in a diaphragmless test cell of the type illustrated in FIG. 2, and dilute brine was electrolyzed to make hypochlorite. The brine was circulated upwards through the cell in the following conditions:

| | |
|---|---|
| Brine concentration | 30 g/l (NaCl) |
| Temperature | 22° C |
| Speed of electrolyte within the inter-electrodic space | 40 cm/sec |
| Current density | 2500 A/m$^2$ |
| Interelectrodic distance | 3.0 mm |
| Cell voltage (average) | 2.9 volt |
| Hypochlorite concentration in the effluent | 2-4 gr/l |
| Current efficiency | 91% |

A similar test cell was used to electrolyze sodium chloride solution to make chlorate. The test assembly consisted of the electrolysis test cell with an associated reactor forming a closed loop system with means for withdrawing chlorate solution, exhausting evolved hydrogen and for introducing fresh brine into the system as commonly practised in commercial chlorate plants.

The test conditions were as follows:

| | | |
|---|---|---|
| Electrolyte composition | NaCl | 90-100 g/l |
| | $NaClO_3$ | 550-600 g/l |
| | $Na_2Cr_2O_7 . H_2O$ | 2-3 g/l |
| Temperature | 80° C | |
| pH | 6.3 to 7 | |
| Speed of electrolyte within the interelectrodic space | 40 cm/sec | |
| Interelectrodic distance | 3.0mm | |
| Current density | 2200 A/m$^2$ | |
| Average cell voltage | 2.8 volt | |
| Current efficiency | 96% | |

The bipolar electrodes operated satisfactorily in both electrolysis processes, and after prolonged operation no deterioration of the operating chracteristics of the cells was observed. In particular, metallographic analysis of the valve metal/aggregate interface did not reveal any indication of hydrogen embrittlement of the valve metal. The cross-sectional electrical conductivity remained unchanged from the initial value, and the mechanical strength of the composite bipolar electrodes was not detectably affected by the prolonged operation.

What is claimed is:

1. A hydrogen-evolution cathode for electrochemical reactions, comprising a body which is substantially impervious to the diffusion therethrough of atomic hydrogen, said body being formed of an aggregate of powdered electrically conductive material embedded in electrically conducting relationship in a cured thermosetting resin and having a cathodically active surface enriched with a powder of a hydrogen evolution catalyst.

2. Cathode of claim 1, wherein the thermosetting resin is selected from the group consisting of furane, phenolic, epoxy, and plastic alloys thereof.

3. Cathode of claim 1, wherein the powdered electrically conductive material comprises at least one material selected from the group consisting of carbon, graphite, chromium, tungsten, iron, nickel, cobalt, cadmium, zinc, copper, molybdenum, silver, and metal carbides, hydrides, nitrides, borides and silicides.

4. Cathode of claim 1, wherein the hydrogen evolution catalyst is iron powder.

5. Cathode of claim 1, wherein the hydrogen evolution catalyst is nickel powder.

6. Cathode of claim 1, wherein the thermosetting resin is an epoxy-based plastic alloy, the powdered electrically conductive material is graphite and the hydrogen evolution catalyst is iron powder.

7. Cathode of claim 1, in which said body comprises a substrate layer havng a thickness of at least 1 mm and a cathodically active surface layer having a thickness of at least 0.5 mm, said substrate layer containing 65 to 80% by weight of the powdered electrically conductive material and said surface layer containing 90 to 97% by weight of the hydrogen evolution catalyst.

8. Cathode of claim 1, in which the thermosetting resin is an epoxy-based plastic, the powdered electrically conductive material comprises at least one material selected from the group consisting of copper, graphite, molybdenum, chromium and TiC, and the hydrogen evolution catalyst is selected from the group consisting of iron and nickel powder and mixtures thereof.

9. A bipolar electrode for electrochemical reactions involving cathodic hydrogen evolution, comprising a valve metal anode having an anodically active surface coated over with a layer of an electrocatalytic anodically resistant material and a cathode bonded to the anode in electrically conducting relationship, the cathode comprising a body which is substantially impervious to the diffusion therethrough of atomic hydrogen, said body being formed of powdered electrically conductive material embedded in electrically conducting relationship in a cured thermosetting resin and having a cathodically active surface enriched with a powder of hydrogen evolution catalyst.

10. Bipolar electrode of claim 9, wherein the hydrogen evolution catalyst is selected form the group consisting of iron and nickel powder.

11. Bipolar electrode of claim 9, wherein the thermosetting resin is selected from the group consisting of furane, phenolic, epoxy, and plastic alloys thereof.

12. Bipolar electrode of claim 9, wherein the powdered electrically conductive material comprises at least one material selected from the group consisting of carbon, graphite, chromium, tungsten, iron, nickel, cobalt, cadmium, zinc, copper, molybdenum, silver and metal carbides, hydrides, nitrides, borides and silicides.

13. A bipolar electrode for electrochemical reactions involving cathodic hydrogen evolution in bipolar diaphragm-less electrolyzers, comprising a substantially planar valve metal anode having an anodically active surface coated over with a layer of an electrocatalytic anodically resistant material and a cathode bonded to the anode in electrically conducting relationship, the cathode comprising a body which is substantially impervious to the diffusion therethrough of atomic hydrogen, said body being formed of an aggregate of powdered electrically conductive material embedded in electrically conducting relationship in a cured thermosetting resin and having a cathodically active surface enriched with a powder of a hydrogen evolution catalyst, said body being extended beyond at least one edge of the cathode and the active surface of the anode by at least one part of cured electrically insulating resin.

14. The bipolar electrode of claim 13, wherein said body and said active surface of the anode are rectangular and are disposed in substantially coincident juxtaposition with two electrically insulating parts of cured resin extending from the opposite edges thereof.

15. In a cell for electrochemical reactions involving cathodic hydrogen evolution, comprising a housing and co-operating electrodes disposed in said housing to provide means for the passage of an electrolyte through the cell, the improvement in which said electrodes operating as cathodes each comprise a body which is substantially impervious to the diffusion of hydrogen, said body being formed of an aggregrate of powdered electrically conductive material embedded in electrically conducting relationship in a cured thermosetting resin and having a cathodically active surface enriched with a powder of a hydrogen evolution catalyst.

16. The cell of claim 15, wherein the thermosetting resin is selected from the group consisting of furane, phenolic, epoxy, and plastic alloys thereof.

17. The cell of claim 15, wherein the powdered electrically conductive material comprises at least one material selected from the group consisting of carbon, graphite, chromium, tungsten, iron, nickel, cobalt, cadmium, zinc, copper, molybdenum, silver, and metal carbides, hydrides, nitrides, borides and silicides.

18. The cell of claim 15, wherein the hydrogen catalyst is selected from the group if iron and nickel powder.

19. The cell of claim 15, wherein each cathode is extended beyond at least one edge by at least one baffle-forming part of cured electrically insulating resin.

20. In a method of electrolysis wherein hydrogen is evolved at a cathodically polarized electrode, the improvement comprising using as the cathodically polarized electrode a body formed of an aggregate of powdered electrically conductive material embedded in electrically conducting relationship in a cured thermosetting resin and having a cathodically active surface enriched with a powder of a hydrogen evolution catalyst whereby atomic hydrogen evolved at the cathodically active surface is substantially prevented from diffusing through said body.

* * * * *